US006821184B1

(12) United States Patent
Yeung

(10) Patent No.: US 6,821,184 B1
(45) Date of Patent: Nov. 23, 2004

(54) STEERING ALIGNMENT SYSTEM FOR A TOY CAR

(75) Inventor: Chan Yeung, Kowloon (CN)

(73) Assignee: Garry Yeung, Hong Kong (HK)

( * ) Notice: Subject to any disclaimer, the term of this patent is extended or adjusted under 35 U.S.C. 154(b) by 0 days.

(21) Appl. No.: 10/634,105

(22) Filed: Aug. 4, 2003

(51) Int. Cl.[7] ..... A63H 30/04

(52) U.S. Cl. ..... 446/456; 446/468; 446/460; 446/465

(58) Field of Search ..... 446/454, 456, 446/460–469

(56) References Cited

U.S. PATENT DOCUMENTS

| | | | | | |
|---|---|---|---|---|---|
| 4,163,341 | A | * | 8/1979 | Jones et al. | 446/138 |
| 4,171,592 | A | * | 10/1979 | Saitoh | 446/456 |
| 4,213,270 | A | * | 7/1980 | Oda | 446/456 |
| 4,739,311 | A | * | 4/1988 | Yamamoto et al. | 341/176 |
| 4,954,820 | A | * | 9/1990 | Kohno et al. | 340/825.69 |
| 5,301,568 | A | * | 4/1994 | Kono | 74/525 |
| 5,334,075 | A | * | 8/1994 | Kakizaki et al. | 446/438 |
| 5,334,076 | A | * | 8/1994 | Shinozuka | 446/456 |
| 5,461,373 | A | * | 10/1995 | Yamamoto et al. | 340/825.69 |
| 5,722,873 | A | | 3/1998 | Ishimoto | |
| 5,751,237 | A | * | 5/1998 | Tanaka | 341/176 |
| 6,338,664 | B1 | * | 1/2002 | Wong | 446/468 |
| 6,445,333 | B1 | * | 9/2002 | Tanaka | 341/176 |
| D468,371 | S | * | 1/2003 | So | D21/566 |
| 2001/0019210 | A1 | * | 9/2001 | Fukasaku et al. | 290/40 C |
| 2002/0147050 | A1 | * | 10/2002 | Weiss et al. | 463/58 |
| 2003/0148703 | A1 | * | 8/2003 | Scott et al. | 446/456 |
| 2003/0214428 | A1 | * | 11/2003 | Tokita | 341/176 |

FOREIGN PATENT DOCUMENTS

| | | | | |
|---|---|---|---|---|
| JP | 05309179 | A | * 11/1993 | A63H/30/04 |

OTHER PUBLICATIONS

Blakey, Marion C., *Safety Recommendation*, Apr. 15, 2002, pp. 1–5, National Transportation Safety Board, Washington D.C.

* cited by examiner

*Primary Examiner*—Derris H. Banks
*Assistant Examiner*—Urszula M Cegielnik
(74) *Attorney, Agent, or Firm*—Wallenstein Wagner & Rockey, Ltd.

(57) ABSTRACT

A steering alignment system for a toy car is disclosed. The system has a variable resistor for providing a resistance in response to a received signal, which variable resistor has a neutral position. There is a steering alignment element capable of changing the neutral position of the variable resistor. The steering alignment element may be a steering trimmer coupled to the variable resistor and/or a trim wheel in communication with the variable resistor. The system has a turning wheel and a steering motor for directing the turning wheel. The system also has a processor coupled to the variable resistor for controlling the steering motor according to the resistance provided by the variable resistor.

30 Claims, 3 Drawing Sheets

STEERING ALIGNMENT SYSTEM FOR A TOY CAR

TECHNICAL FIELD

This invention relates generally to a steering alignment system for a toy car. More particularly, this invention relates to a steering alignment system for a toy car having a variable resistor with a neutral position and a steering alignment element capable of changing the neutral position of the variable resistor.

BACKGROUND OF THE INVENTION

The steering systems of radio-controlled toy cars have become increasingly complex in order to provide rapid turning capabilities. As complicated and technologically-advanced as toy car steering systems have become, the wear and tear of normal use still causes many toy cars to begin to veer to the right or to the left when a transmitter attempts to direct the toy car to drive in a straight line. If left uncorrected, the veering can worsen until the toy car is essentially turning to the left or to the right when the transmitter is instructing the toy car to drive straight. As a result, there is a need for a steering alignment system that can be used to re-align the toy car's steering mechanism in the event the toy car starts to veer in either direction when a transmitter is directing the toy car to drive in a straight line. Such a system will help to extend the useful life of toy cars, especially those used by children who tend to direct toy cars into other objects, and drive them onto rough terrain.

SUMMARY OF THE INVENTION

One aspect of the present invention provides a steering alignment system for a toy car having a variable resistor for providing a resistance in response to a received signal, which variable resistor has a neutral position. There is a steering trimmer coupled to the variable resistor, so that adjustment of the steering trimmer changes the neutral position of the variable resistor. The system has a turning wheel and a steering motor for directing the turning wheel. The system also has a processor coupled to the variable resistor for controlling the steering motor according to the resistance provided by the variable resistor.

Another aspect of the present invention provides a steering alignment system for a toy car having a variable resistor for providing a resistance in response to a received signal, which variable resistor has a neutral position. There is a trim wheel in communication with the variable resistor, so that adjustment of the trim wheel changes the neutral position of the variable resistor. The system has a turning wheel and a steering motor for directing the turning wheel. The system also has a processor coupled to the variable resistor for controlling the steering motor according to the resistance provided by the variable resistor.

Still another aspect of the present invention provides a steering alignment system for a toy car having a remote controller and a trim wheel.

Other objects, advantages, and aspects of the present invention will become apparent upon reading the following description of the drawings and detailed description of the invention.

DETAILED DESCRIPTION OF A PREFERRED EMBODIMENT OF THE INVENTION

Figure 1:
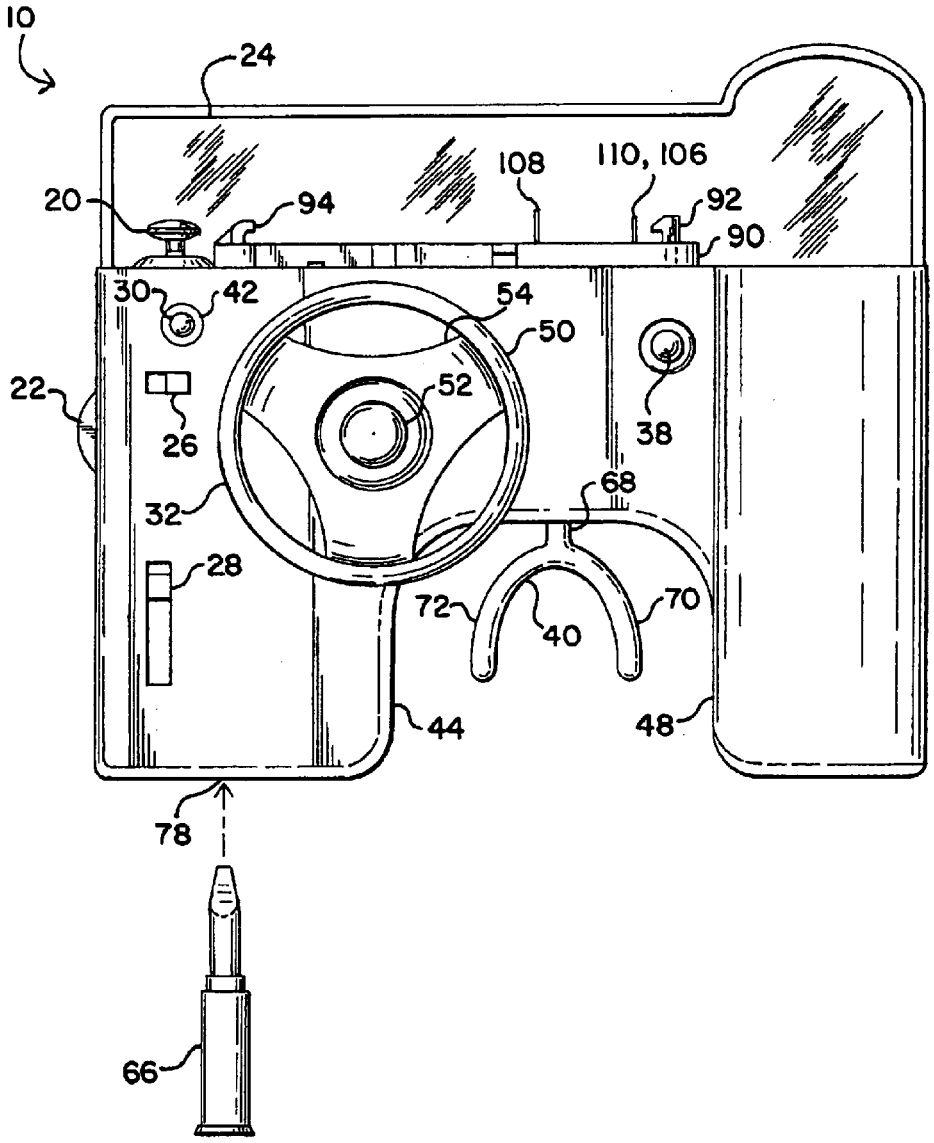
FIG. 1 is a perspective view of a remote controller.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring to the drawings, FIG. 1 shows a remote controller 10 for controlling a toy car 60 in accordance with the invention. The remote controller 10 of FIG. 1 is preferably a radio transmitter, but may be any kind of remote controller. For example, the remote controller I0 may be an infrared transmitter. The remote controller 10 includes an extendable antenna 20 and a flip-top cover 24. To extend the antenna 20, the user opens the flip-top cover 24 and pulls on the end of antenna 20 until the antenna 20 is fully extended.

The remote controller 10 is turned on and off using a power switch 26. The remote controller 10 is powered using four AAA batteries. A frequency selector 28 containing numbers one through six is also included as part of the remote controller 10. Switching the frequency selector 28 functions to change the frequency that the remote controller 10 is emitting, so that six different toy cars 60 can run at the same time using each of the six provided frequencies.

Figure 2:
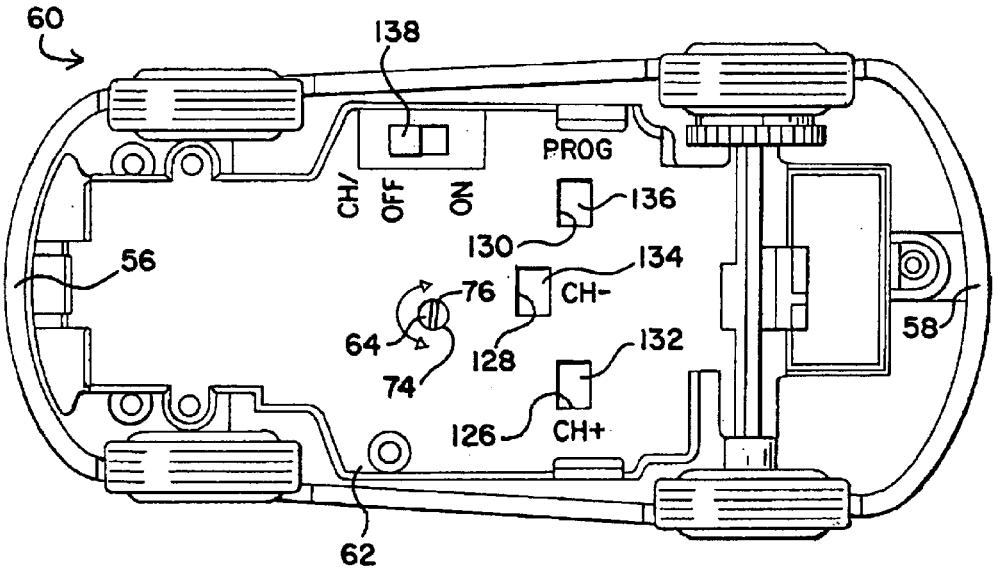
FIG. 2 is a bottom view of a toy car.

As can be seen in FIG. 2, the toy car 60 is turned on and off using a power switch 138. The toy car 60 is powered using a rechargeable battery. The remote controller 10 has three charging electrodes 106, 108 and 110 that extend upwardly from a charging platform 90 located on the top of the remote controller 10. The charging platform 90 has a stationary front hook 94 and a spring-loaded rear catch 92 with a keeper. As can be seen in FIG. 2, the bottom of the toy car 60 has a chassis 62 with three apertures 126, 128 and 130 housing three charge-receiving electrodes 132, 134 and 136. To charge the rechargeable battery used to power the toy car 60, the flip-top cover 24 of the remote controller 10 is opened and the toy car is connected to the charging platform 90. A detent in the front end 56 of the toy car 60 is mated with the front hook 94, and the toy car 60 is lowered onto the charging platform 90 until a detent in the rear end 58 of the toy car 60 engages the keeper of the rear catch 92.

When the toy car 60 is connected to the charging platform 90 as just described, the charging electrodes 106, 108, and 110 on the top of the remote controller 10 mate with the charge-receiving electrodes 132, 134 and 136 on the bottom of the toy car. In order to disconnect the toy car 60 from the charging plate 90, the user pushes a release button 38. The release button 38 releases the spring-loaded rear catch 92, so that the toy car 60 can be removed from the charging plate 90 without damaging the toy car 60, the front hook 94, or the rear catch 92.

During charging, the power switch 138 for the toy car 60 can be in the "ON" position or the "OFF" position, and the power switch 26 for the remote controller 10 should be in the "ON" position. When the user connects the toy car 60 to the top of the remote controller 10 for charging, a program runs before the charging process begins. When the power switch 138 for the toy car 60 is in the "ON" position, the program directs the toy car 60 to operate in one of the six available frequencies. This allows up to six toy cars to run at the same time, each using one of the six different frequencies. When the power switch 138 for the toy car 60 is in the "OFF" position, the program runs, but is unsuccessful. Therefore, it is preferable that the power switch 138 for the toy car 60 be in the "ON" position during charging.

During charging, an LED 30 housed in an LED enclosure 42 on the remote controller 10 emits a red light. When charging is complete, the LED 30 changes from red to green, indicating that the toy car 60 is charged. When the power switch 26 for the remote controller 10 is in the "OFF" position, the LED 30 does not emit any light at all.

Figure 4:
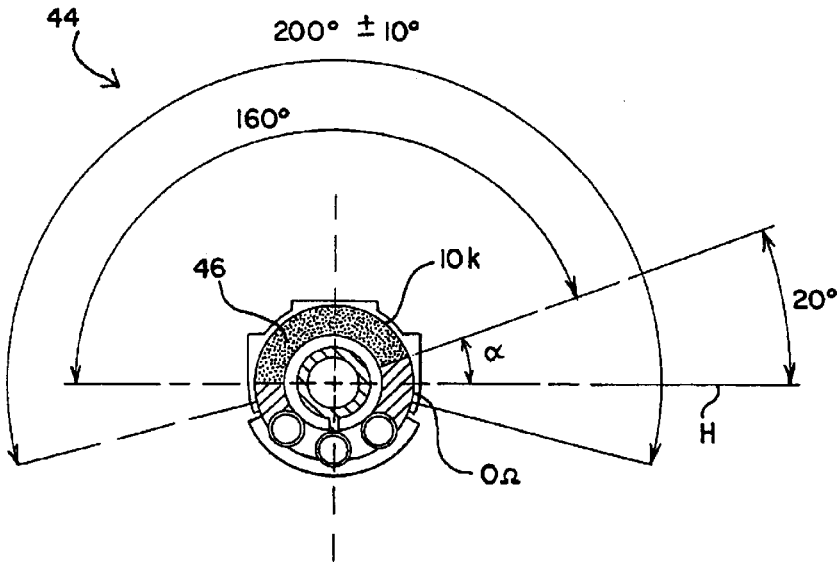
FIG. 4 is a cross-sectional view of a variable resistor with a modified membrane.

Referring back to FIG. 1, the remote controller 10 has an adjustable trim wheel 22. Preferably, the trim wheel 22 is manually adjustable and located on an outside surface of the remote controller 10. While this design is preferred for easy user accessibility to the trim wheel 22, the trim wheel 22 may be located anywhere on or in the remote controller 10. Additionally, a tool may be required to adjust the trim wheel 22. The trim wheel 22 is in communication with a variable resistor 44, or potentiometer (FIG. 4). Optionally, there can be more than one variable resistor 44. Preferably, the variable resistor 44 is a turn pot variable resistor with a membrane 46 that is modified by an angle a of about 20° from a horizontal axis H, as shown in FIG. 4.

The variable resistor 44 has a neutral position, which neutral position can be changed by adjusting the trim wheel 22. A user can also change the neutral position of the variable resistor 44 by adjusting a steering trimmer 64 coupled to the variable resistor 44. Referring to FIG. 2, the steering trimmer 64 is preferably located on an exposed underside of the chassis 62 for easy accessibility to the steering trimmer 64. As shown in FIG. 2, the chassis 62 includes a recessed portion 74 enclosing the steering trimmer 64. The steering trimmer 64 is adjustable. Preferably, the steering trimmer 64 has a slot 76 for receiving a small screwdriver 66 or any other tool that can be used to rotate the steering trimmer 64 in a horizontal plane. The screwdriver 66 or other tool is inserted into the slot 76 of the steering trimmer 64 and turned in a desired direction of rotation. When the screwdriver 66 is not in use, it is housed in an orifice 78 located on the bottom of the remote controller 10.

Figure 3:
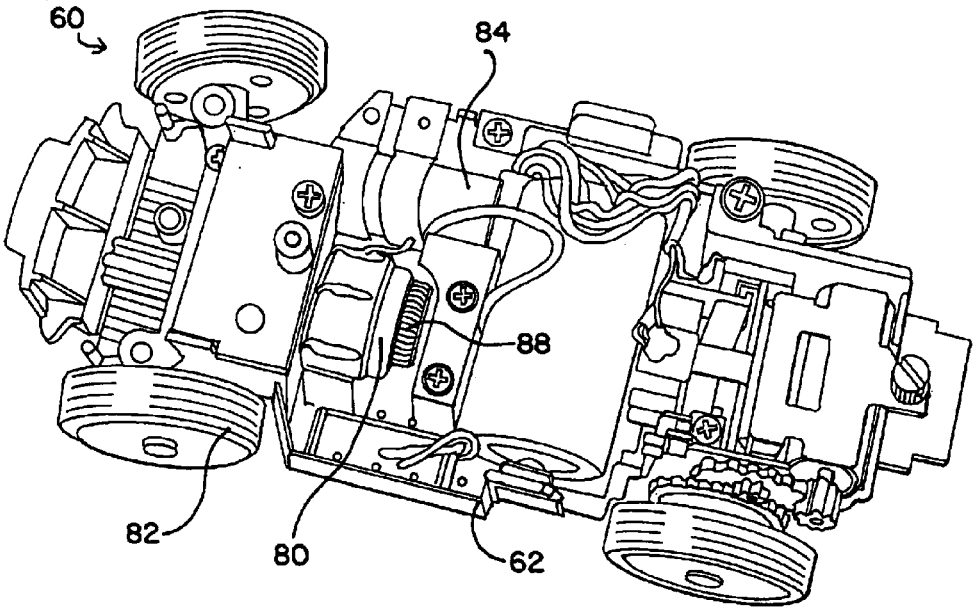
FIG. 3 is a photograph of a portion of a toy car.

The variable resistor 44 is housed inside a rotatable housing 80 mounted on the chassis 62 of the toy car 60, as can be seen in FIG. 3. The rotatable housing 80 is fixedly attached to the variable resistor 44. The rotatable housing 80 has a serrated edge 88, which cooperates with the steering trimmer 64, so that when the steering trimmer 64 is rotated, the rotatable housing 80 fixedly attached to the variable resistor 44 is also rotated, thereby adjusting the neutral position of the variable resistor 44.

Figure 5:
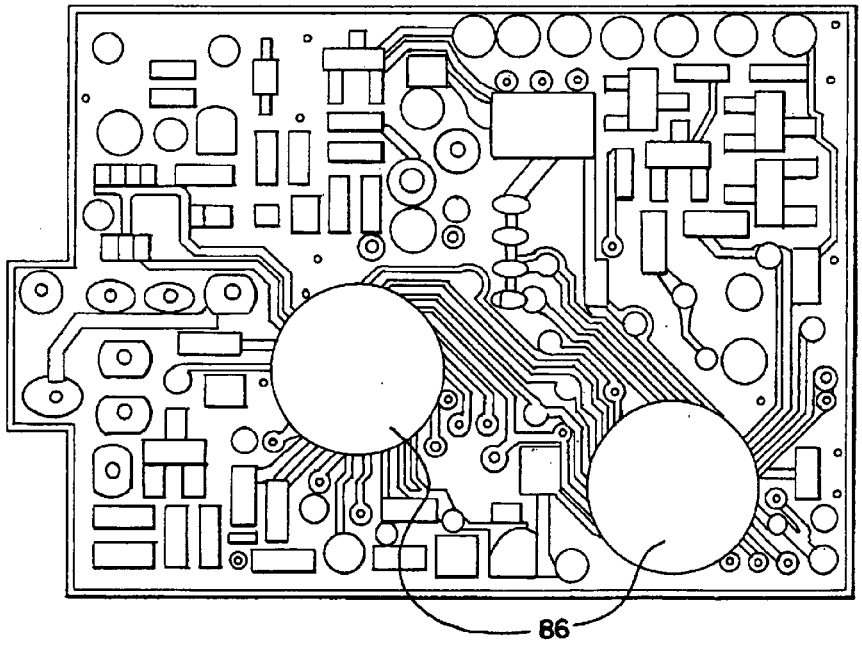
FIG. 5 is a photograph of a toy car circuit board.

The variable resistor 44 provides a resistance in response to a signal received from the remote controller 10. A processor 86 (FIG. 5) is coupled to the variable resistor 44 for controlling a steering motor 84 according to the resistance provided by the variable resistor 44. Preferably, the signal received from the remote controller 10 is a radio frequency signal. However, the type of signal received from the remote controller 10 naturally depends on the type of remote controller used.

The remote controller 10 has a steering wheel 32 for controlling the left to right direction of the toy car 60. The steering wheel 32 has a steering wheel rim 50 and a steering wheel face 54, both of which pivot about a pivot point 52. The steering wheel 32 has a central position. When the user turns the steering wheel 32 about the pivot point 52, the remote controller 10 sends a signal to the variable resistor 44, causing the variable resistor 44 to modify its resistance from the neutral position in order to correspond to the direction being called for by the steering wheel 32 on the remote controller 10. The modified resistance is then provided to the processor 86, which controls the steering motor 84. The steering motor then causes various steering gears to move accordingly. The movement of the steering gears turns one or more turning wheels 82 to correspond to the direction being called for by the steering wheel 32 on the remote controller 10.

When the user releases the steering wheel 32, the steering wheel 32 returns to its central position. When this occurs, the remote controller 10 sends a signal to the variable resistor 44 instructing the variable resistor 44 to return to the neutral position. The variable resistor 44 then provides the resistance corresponding to the neutral position to the processor 86. The processor 86 instructs the steering motor 84 to move the steering gears accordingly to return the turning wheel(s) 82 back to its original position.

The remote controller 10 also has a shifter 68 for controlling the forward and backward movement of the toy car 60. The shifter extends from the bottom of the remote controller 10 and includes an ergonomic finger rest 40 for ease of use. The ergonomic finger rest 40 has a left side 72 and a right side 70. When the user applies pressure to the left side 72 of the ergonomic finger rest 40, the remote controller 10 instructs the toy car 60 to move in a forward direction. Oppositely, when the user applies pressure to the right side 70 of the ergonomic finger rest 40, the remote controller 10 instructs the toy car 60 to move in reverse.

The components of the steering alignment system cooperate to maintain the movement of the toy car 60 in a generally straight direction when She signal received from the remote controller 10 calls for the toy car 60 to move in a straight direction. The toy car 60 is considered properly aligned if it moves in a generally straight line when the variable resistor 44 is in the neutral position, i.e., when the remote controller 10 calls for the toy car 60 to move in a straight line. If the toy car 60 begins to veer to the right or to the left when the remote controller 10 calls for the toy car 60 to go straight, the trim wheel 22 and/or the steering trimmer 64 may be adjusted, thereby changing the neutral position of the variable resistor 44, which functions to change the initial angle of the turning wheel(s) 82. In this manner, the toy car 60 can be re-aligned as often as necessary over its useful life.

While specific embodiments have been illustrated and described, numerous modifications are possible without departing from the spirit of the invention, and the scope of protection is only limited by the scope of the accompanying claims.

What is claimed is:

1. A steering alignment system for a toy car comprising:

a variable resistor for providing a resistance in response to a received signal, the variable resistor having a neutral position;

a steering trimmer coupled to the variable resistor so that adjustment of the steering trimmer changes the neutral position of the variable resistor;

to a turning wheel;

a steering motor for directing the turning wheel; and a processor coupled to the variable resistor for controlling the steering motor according to the resistance provided by the variable resistor.

2. The steering alignment system of claim 1, wherein the components of the steering alignment system cooperate to maintain the movement of the toy car in a generally straight direction when the received signal calls for the toy car to move in a straight direction.

3. The steering alignment system of claim 1, wherein the movement of the toy car is maintained in a generally straight direction when the variable resistor is in the neutral position.

4. The steering alignment system of claim 1 further comprising:

a toy car chassis having an exposed underside, wherein the steering trimmer is located on the exposed underside of the toy car chassis for easy accessibility to the steering trimmer.

5. The steering alignment system of claim 4, wherein the toy car chassis includes a recessed portion enclosing the steering trimmer.

6. The steering alignment system of claim 1, wherein the steering trimmer has a slot for receiving a tool.

7. The steering alignment system of claim 6, wherein the tool is a screwdriver.

8. The steering alignment system of claim 6, wherein the steering trimmer is rotatable in a horizontal plane by inserting the tool into the slot and turning the tool in a desired direction of rotation.

9. The steering alignment system of claim 8 further comprising:

a rotatable housing fixedly attached to the variable resistor, the rotatable housing having a serrated edge, wherein the serrated edge of the rotatable housing cooperates with the steering trimmer so that when the steering trimmer is rotated, the rotatable housing fixedly attached to the variable resistor is also rotated, thereby adjusting the neutral position of the variable resistor.

10. The steering alignment system of claim 1, wherein the signal received by the variable resistor is a radio frequency signal emitted from a radio transmitter.

11. The steering alignment system of claim 1, wherein the variable resistor is a turn pot variable resistor.

12. The steering alignment system of claim 1 further comprising:

a membrane inside the variable resistor, wherein the membrane is modified by an angle of about 20° from a horizontal axis.

13. A steering alignment system for a toy car comprising:

a variable resistor for providing a resistance in response to a received signal, the variable resistor having a neutral position;

a trim wheel in communication with the variable resistor so that adjustment of the trim wheel changes the neutral position of the variable resistor;

a turning wheel;

a steering motor for directing the turning wheel; and a processor coupled to the variable resistor for controlling the steering motor according to the resistance provided by the variable resistor.

14. The steering alignment system of claim 13, wherein the components of the steering alignment system cooperate to maintain the movement of the toy car in a generally straight direction when the received signal calls for the toy car to move in a straight direction.

15. The steering alignment system of claim 13, wherein the movement of the toy car is maintained in a generally straight direction when the variable resistor is in the neutral position.

16. The steering alignment system of claim 13, wherein the variable resistor is a turn pot variable resistor.

17. The steering alignment system of claim 13 further comprising:

a membrane inside the variable resistor, wherein the membrane is modified by an angle of about 20° from a horizontal axis.

18. The steering alignment system of claim 13, wherein the signal received by the variable resistor is a signal emitted from a remote controller.

19. The steering alignment system of claim 13, wherein the signal received by the variable resistor is a radio frequency signal emitted from a radio transmitter.

20. The steering alignment system of claim 13 further comprising:

a remote controller, wherein the trim wheel is located on the remote controller.

21. The steering alignment system of claim 13, wherein the trim wheel is manually adjustable.

22. A remote controller for a toy car comprising:

a trim wheel.

23. The remote controller of claim 22, wherein the trim wheel is located on an outside surface of the remote controller for easy accessibility to the trim wheel.

24. The remote controller of claim 22, wherein the trim wheel is manually adjustable.

25. The remote controller of claim 22, wherein the trim wheel is in communication with a variable resistor.

26. The remote controller of claim 25, wherein the variable resistor has a neutral position, which neutral position may be changed by adjusting the trim wheel.

27. The remote controller of claim 25, wherein the variable resistor is a turn pot variable resistor.

28. The remote controller of claim 25 further comprising:

a membrane inside the variable resistor, wherein the membrane is modified by an angle of about 20° from a horizontal axis.

29. The remote controller of claim 25, wherein the variable resistor provides a resistance in response to a signal received from the remote controller.

30. The remote controller of claim 29, wherein the signal received from the remote controller is a radio frequency signal.

* * * * *

UNITED STATES PATENT AND TRADEMARK OFFICE

CERTIFICATE OF CORRECTION

PATENT NO. : 6,821,184 B1
APPLICATION NO. : 10/634105
DATED : November 23, 2004
INVENTOR(S) : Chan Yeung It is certified that error appears in the above-identified patent and that said Letters Patent is hereby corrected as shown below:

Column 3, line 24, “a” should be -- α --

Column 4, line 33, “She” should be -- the --

Column 4, line 61, the word “to” should be deleted

Signed and Sealed this

Nineteenth Day of September, 2006

JON W. DUDAS
*Director of the United States Patent and Trademark Office*